US006223490B1

(12) United States Patent
Wessley et al.

(10) Patent No.: US 6,223,490 B1
(45) Date of Patent: May 1, 2001

(54) SCUTTLE HOLE INSULATION SYSTEM

(76) Inventors: Robert Wessley, 2792 Packerland Dr., Green Bay, WI (US) 54307; Neil Van Boxtel, N4149 County Rd. U, DePere, WI (US) 54115

( * ) Notice: Subject to any disclaimer, the term of this patent is extended or adjusted under 35 U.S.C. 154(b) by 0 days.

(21) Appl. No.: 09/391,556

(22) Filed: Sep. 8, 1999

(51) Int. Cl.[7] ..... E06B 3/26

(52) U.S. Cl. ..... 52/404.1; 52/202; 49/463; 49/465

(58) Field of Search ..... 52/202, 404.5, 52/407.2, 407.4; 49/62, 465, 463, 466

(56) References Cited

U.S. PATENT DOCUMENTS

| | | | | |
|---|---|---|---|---|
| 4,130,966 | * | 12/1978 | Kujawa, Jr. et al. | 49/463 X |
| 4,151,894 | * | 5/1979 | Edwards | 49/463 X |
| 4,337,602 | | 7/1982 | KIng | 52/202 |
| 4,438,613 | * | 3/1984 | Hintsa et al. | 49/465 X |
| 4,483,102 | * | 11/1984 | Edwards | 49/465 |
| 4,658,555 | | 4/1987 | Steiner | 52/202 |
| 4,944,126 | | 7/1990 | King | 52/202 |
| 5,271,198 | | 12/1993 | Freeman | 52/202 |
| 5,404,676 | * | 4/1995 | Devlin | 49/463 |
| 5,461,831 | * | 10/1995 | Michal | 52/202 X |
| 5,475,955 | | 12/1995 | Dickinson | 52/202 |
| 5,623,795 | | 4/1997 | Padgett, Jr. | 52/202 |
| 5,628,151 | | 5/1997 | Monat | 52/202 X |
| 5,765,312 | * | 6/1998 | Szyjkowski | 49/465 |
| 6,014,841 | * | 1/2000 | McCoy, Jr. et al. | 52/202 X |

* cited by examiner

*Primary Examiner*—Peter M. Cuomo
*Assistant Examiner*—Rodney B. White
(74) *Attorney, Agent, or Firm*—Reinhart, Boerner, Van Deuren, Morris & Rieselbach, s.c.

(57) ABSTRACT

Disclosed is a scuttle hole cover comprising a sleeve and an insulating cap. The sleeve extends into the attic through the scuttle hole and includes a locking mechanism for locking an insulating cover in place. The insulating cap includes a mating locking mechanism and, when inserted into the sleeve, locks into place.

18 Claims, 2 Drawing Sheets

SCUTTLE HOLE INSULATION SYSTEM

BACKGROUND

This invention relates generally to attic insulation systems, and more particularly to an insulation system designed to insulate a conventional ceiling entrance, or "scuttle hole".

Scuttle holes exist in many buildings, especially in homes. These scuttle holes generally provide access to the storage space in the attic of a home through pull-down covers, many of which include a set of expandable stairs to allow easy access. However, attic insulation generally stops at the scuttle hole to allow access through the attic floor. Consequently, a significant amount of heat generally escapes through the scuttle hole opening.

Although existing insulating devices for scuttle holes are generally effective for the purposes intended, such devices are often difficult to transport and install. Furthermore, such devices are generally susceptible to heat leakage and are often difficult both to insert and remove when access to the scuttle hole is required.

It is therefore an object of the invention to provide a scuttle hole cover which is easy to transport.

It is another object of the invention to provide a scuttle hole cover which is easy to install.

It is still another object of the invention to provide a scuttle hole cover which greatly minimizes heat leakage.

It is yet another object of the invention to provide a scuttle hole cover which is easy to selectively insert and remove as access to the attic is required.

SUMMARY OF THE INVENTION

The present invention provides a scuttle hole cover comprising a sleeve, and an insulating cap. The sleeve extends into the attic through the scuttle hole and includes a locking mechanism for locking an insulating cover in place. The insulating cap includes a mating locking mechanism, and when inserted into the sleeve, locks into place.

In a preferred embodiment, the sleeve is inserted into the scuttle hole and extends into the attic in a direction substantially perpendicular to the sides of the hole. The sleeve preferably includes a flange which engages the ceiling abutting the scuttle hole. Preferably, the flange further comprises an angled section, which angles from a first section toward the ceiling when inserted to provide a more tight seal of the scuttle hole. A gasket or other type of weather stripping is also preferably positioned between the flange and the ceiling. A locking mechanisms that may comprise a series of molded indents or dimples extend in a direction generally perpendicular to the wall of the sleeve to provide a means for locking the insulated cover to the sleeve.

The insulating cover can be dimensioned to enclose the scuttle hole, and to press-fit into the sleeve. The raised sides of the insulating cover can include a series of locking channels or ridges for coupling the insulating cover to the molded indents or dimples in the sleeve. Preferably, the insulated cover includes at least one handle to simplify inserting and removing the cover from the scuttle hole.

The combination of an insertable sleeve and insulated cover provides a scuttle hole cover which is easy to install and easy to both remove and reinsert to provide selective access to the attic. The molded indent or dimple and locking channel provide a tight seal to provide a high insulating factor, and to minimize the amount of heat which escapes through the scuttle hole.

Other advantages and features of the invention, together with the organization and manner of operation thereof, will become apparent from the following detailed description when taken in conjunction with the accompanying drawings wherein like elements have like numerals throughout the drawings.

DETAILED DESCRIPTION OF THE PREFERRED EMBODIMENTS

Figure 1:
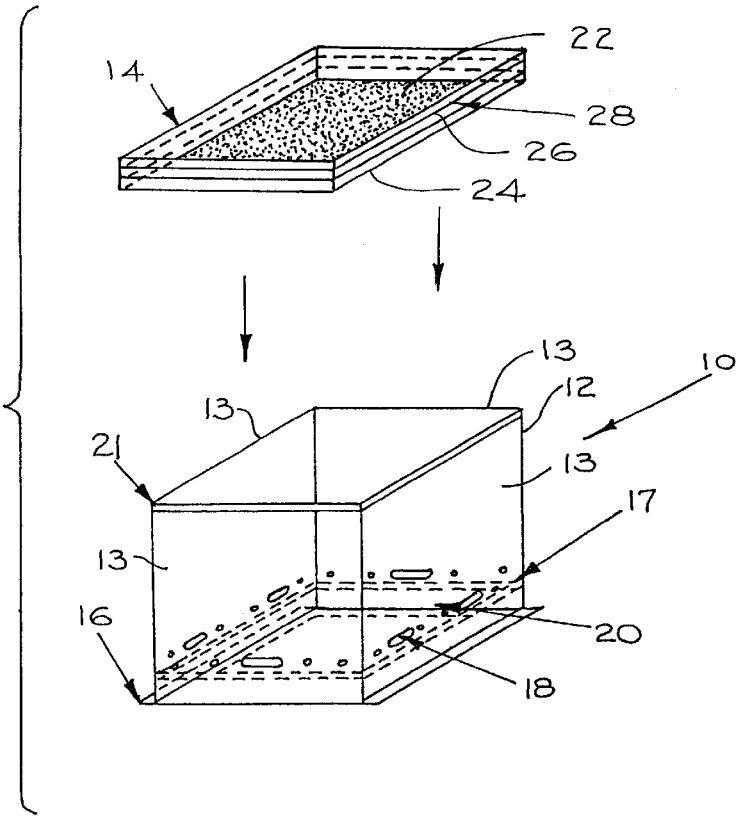
FIG. 1 is an exploded view of a scuttle hole cover in accordance with the present invention.

Referring to the Figures, and more particularly to FIG. 1, a preferred embodiment of a scuttle hole cover of the present invention is shown at 10. The scuttle hole cover generally comprises two parts: a sleeve 12, and an insulating cap 14. The sleeve 12 is designed to provide a framework for inserting the insulating cap 14 into the scuttle hole. Preferably, the insulating cap locks into position in the sleeve 12 to seal the attic from the rest of the house.

Figure 2:
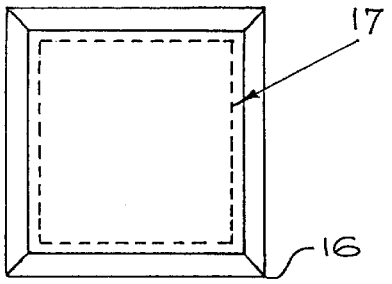
FIG. 2 is a bottom view of the sleeve shown in FIG. 1.
Figure 3:
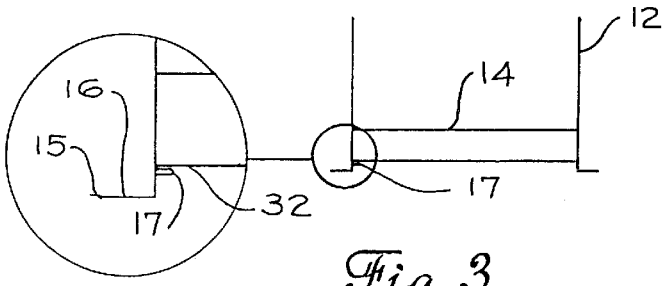
FIG. 3 is a cutaway view of the scuttle hole cover of FIG. 1.

Referring now to FIGS. 1 and 2, the sleeve 12 comprises four members or walls 13. Preferably, the sleeve 12 is generally rectangular, and is dimensioned to fit closely to the inside perimeter of the scuttle hole opening. The sleeve 12 includes a flange 16, the flange extending in a generally perpendicular direction to the bottom of the sleeve 12. Referring now to FIG. 3, the flange 16 preferably includes an angled section 15, which extends upwardly at an angle of substantially fifteen degrees as referenced to the generally perpendicular flange 16. The angled section 15 provides a tight seal between the sleeve 12 and the ceiling surrounding the scuttle hole. Although a substantially fifteen degree angle is shown, it will be apparent that the angle could be varied depending on the type of materials used and the strength of the seal required. Furthermore, although a generally rectangular sleeve 12 is shown, it will be apparent to one of ordinary skill in the art that the shape of the sleeve 12 will be determined by the shape of the scuttle hole, and that the invention is not confined to rectangular scuttle holes. Depending on the shape of the scuttle hole cover, the number and shape of the members 13 will also vary.

Referring again to FIGS. 1 and 2, the sleeve 12 also preferably includes a plurality of molded indents 18 extending in a substantially perpendicular direction toward the center of the scuttle hole, and a plurality of mounting holes 20. The mounting holes 20 provide a location for receiving conventional coupling devices such as screws and nails. In some applications, however, self-tapping coupling device or other coupling may also be used. The sleeve 12 preferably includes a rest ledge 17 which extends in a direction substantially perpendicular to the walls 13 of the sleeve 12 and toward the center of the sleeve 12. The rest ledge 17 is dimensioned to receive the insulating cap 14 as will be described below. Referring now to FIG. 3, a gasket 32 comprising foam rubber, weatherstripping, or another insulating material is preferably coupled to the rest ledge 17 for providing an additional insulating layer. The gasket 32 helps to prevent air from escaping from the attic into the house through the edge between the rest ledge 17 and the insulating cap 14. The sleeve 12 also preferably includes a stiffener hem 21. The stiffener hem 21 provides a slightly thicker portion of the sleeve 12 for retaining the shape of the sleeve 12 as the sleeve 12 is inserted into a scuttle hole.

The insulating cap 14 generally comprises a base section 22, and four insulating walls 24. The base section 22 is generally rectangular and is dimensioned to enclose the opening at the inner perimeter of the sleeve 12 but can be shaped to fit any style or shape of scuttle hole sleeve. The insulating walls 24 extend vertically in a direction substantially perpendicular to the base section 22. Each insulating wall 24 can comprise a series of ridges 28. The ridges 28 provide a locking channel 26 which mates with the molded indents 18 or other locking mechanisms to lock the insulating cap 14 to the sleeve 12, thereby providing a seal. Preferably, the insulating cap 14 includes at least one handle (not shown) which may be molded to the insulating cap 14 or coupled to the cover 14 in other known ways. Preferably the insulating cap 14 comprises an insulating foam material, although it could comprise a number of insulating materials, a metal or plastic frame in combination with insulating materials, or other types of insulating covers. As noted above, preferably a gasket 32 is coupled between the insulating cap 14 and the rest ledge 17 of the sleeve 12. Although a specific locking device comprising indents 18 molded to the sleeve 12 and locking channels 28 molded to the cap 14 has been shown, it will be apparent that this order could be reversed. Furthermore, other types of indent and locking channel mechanisms could be coupled to the sleeve 12 and insulating cap 14, and that other type of mating locking arrangements could also be employed. Alternatively, the insulating cap 14 could be coupled to the sleeve 12 with hook and loop type fasteners, or other similar releasable mechanisms. Furthermore, although a generally rectanular insulatory cap 14 is shown, it will be apparent that the insulating cap 14 can be of any shape requires by the sleeve 12 and the scuttle hole.

To install the scuttle hole cover 10, the sleeve 12 is initially installed in the scuttle hole, with the flange 16 abutting the ceiling around the opening. The angled section 15 seals the flange 16 and, hence, the sleeve 12 to the surrounding ceiling. Preferably, weather stripping, foam, rubber, plastic or other insulating material can be provided between the flange 16 and the ceiling to provide a tight seal. Conventional coupling devices such as but not limited to screws or nails are inserted through the mounting holes 20 to mount the sleeve to the ceiling joists. The insulating cap 14 is received in the sleeve, and pulled down until the insulating cap 14 rests on the rest ledge 17, and the molded indents 18 mate with the channel 28. A tight seal is thereby provided around the scuttle hole. Preferably, the insulating cap 14 is grasped by the handles and inserted into the sleeve the floor of the house or building.

Figure 4:
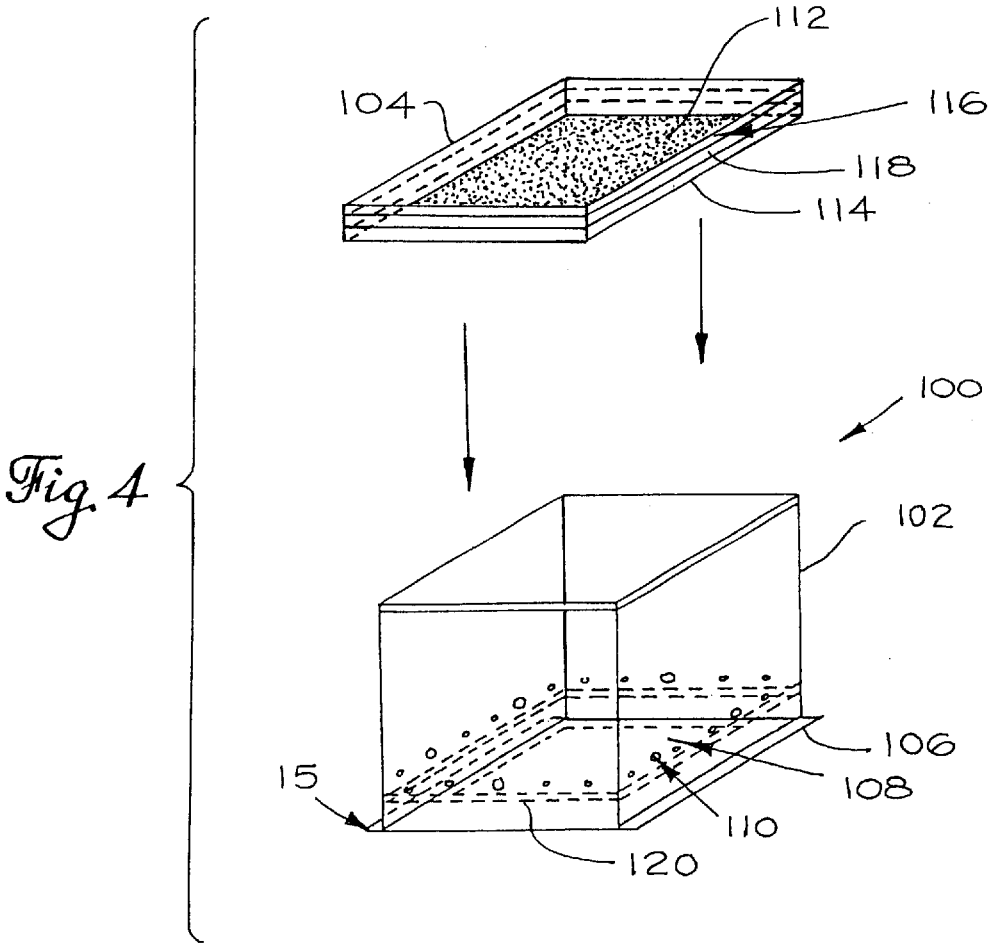
FIG. 4 is an exploded view of an alternative embodiment of the invention.
Figure 5:
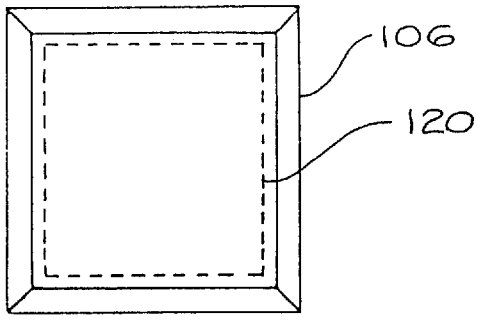
FIG. 5 is a bottom view of the sleeve of FIG. 4.

A second embodiment of a scuttle hole cover is shown at 100 in FIG. 4. In this embodiment, the scuttle hole cover also comprises two parts: a sleeve 102 and an insulating cap 104.

The sleeve 102 is generally rectangular, although it can be shaped to fit any scuttle hole, and is dimensioned to fit closely to the inside perimeter of the scuttle hole opening. The sleeve 102 includes a flange 106, the flange extending in a generally perpendicular direction to the bottom of the sleeve 102. The sleeve 102 also includes a plurality of dimples 110 extending in a substantially perpendicular direction toward the center of the scuffle hole, and a plurality of mounting holes 108. The mounting holes 108 provide a location for receiving conventional coupling devices such as screws and nails. The sleeve 102 also preferably includes a rest ledge 120 dimensioned to receive the insulating cap 104.

The insulating cap 104 is generally rectangular and comprises a base section 112, and four insulating walls 114. The base section 112 is generally rectangular and is dimensioned to enclose the opening at the inner perimeter of the sleeve 102. The insulating walls 114 extend vertically in a direction substantially perpendicular to the base section 112. Each insulating wall 114 comprises a series of parallel channels 118, the parallel channels 118 being separated by a series of ridges 116. The ridges 116 provide a locking channel 116 which mates with the dimples 106 to lock the insulating cap 104 to the sleeve 102, thereby providing a seal.

To install this scuttle hole cover, the sleeve 102 is initially installed in the scuttle hole, with the flange 106 abutting the ceiling around the opening. Preferably, weather stripping can be provided between the flange 106 and the ceiling to provide a tight seal. Conventional coupling devices such as screws or nails are inserted through the mounting holes 108 to mount the sleeve to the ceiling joists. The insulating cap 104 is received in the sleeve, and pulled down until the dimples 110 mate with the channels 118. A tight seal around the scuttle hole is thereby provided.

While preferred embodiments have been illustrated and described, it should be understood that changes and modifications can be made thereto without departing from the invention in its broadest aspects. Various features of the invention are defined in the following claims.

We claim:

1. A scuttle hole insulator comprising:

a sleeve dimensioned to surround a scuttle hole opening;

a plurality of locking indents, extending from an interior edge of the sleeve and substantially perpendicular to the interior edge of the sleeve; and an insulating cap, dimensioned to enclose the scuttle hole opening, the insulating cap including a locking channel which is removably coupled to the locking indents.

2. The scuttle hole insulator of claim 1, wherein said sleeve includes a plurality of walls and a flange, the flange extending in a direction generally perpendicular to the walls of the sleeve.

3. The scuttle hole insulator as defined in claim 2, wherein the flange includes an angled section.

4. The scuttle hole insulator of claim 1, wherein said sleeve comprises four walls, the four walls being arranged in generally rectangular spatial relationship.

5. The scuttle hole insulator of claim 1, wherein said sleeve further comprises a plurality of mounting holes dimensioned to receive coupling devices.

6. The scuttle hole insulator of claim 5, wherein said coupling devices comprise screws.

7. The scuttle hole insulator of claim 1, wherein said sleeve further includes a stiffener hem.

8. The scuttle hole insulator of claim 1, wherein said insulating cap comprises an insulator base section dimensioned to enclose the scuttle hole, and at least one wall, the at least one wall extending in a generally perpendicular direction from the perimeter of the insulator base section.

9. The scuttle hole insulator of claim 8, wherein the locking channel comprises a plurality of parallel channels.

10. A scuttle hole insulator comprising:

a generally rectangular sleeve comprising four walls, the sleeve dimensioned to surround a scuttle hole opening;

a flange, coupled to the sleeve and extending in a direction substantially perpendicular to each of the four walls and away from the center of the generally rectangular sleeve, the flange including an angled section for providing a seal to a ceiling surrounding a scuttle hole;

a rest ledge, coupled to the sleeve and extending in a direction substantially perpendicular to each of the four walls and toward the center of the generally rectangular sleeve;

a plurality of locking indents, extending from an interior edge of the sleeve and substantially perpendicular to the interior edge of the sleeve; and an insulating cap, dimensioned to enclose the scuttle hole opening, the insulating cap including a locking channel which is removably coupled to the locking indents.

11. The scuttle hole cover as defined in claim 10, further comprising a gasket between the rest ledge and the insulating cap.

12. The scuttle hole cover as defined in claim 10, wherein the angled section of the flange is angled substantially fifteen degrees from the generally perpendicular flange.

13. The scuttle hole cover as defined in claim 10, wherein the sleeve further comprises a plurality of mounting holes for coupling the sleeve to ceiling joists of a ceiling containing the scuttle hole opening.

14. A method for sealing an attic scuttle hole to insulate a building, the method comprising the following steps:

forming a sleeve including a flange, the sleeve being dimensioned to fit in the inside perimeter of the scuttle hole;

inserting the sleeve into the scuttle hole such that the flange engages a ceiling abutting the scuttle hole;

coupling the sleeve to ceiling joists surrounding the scuttle hole; and coupling an insulating cap into the sleeve.

15. The method as defined in claim 14 further including the step of providing mating locking mechanisms on the sleeve and the insulating cap.

16. The method as defined in claim 14, further comprising the step of forming a rest ledge in the sleeve, the rest ledge being dimensioned to receive the insulating cap.

17. The method as defined in claim 16, further comprising the step of coupling a gasket between the rest ledge and the insulating cap.

18. The method as defined in claim 14, further comprising the step of coupling a gasket between the flange and the ceiling.

* * * * *